United States Patent [19]

Michel

[11] Patent Number: 4,483,384

[45] Date of Patent: Nov. 20, 1984

[54] APPARATUS FOR HARDENING MOLD PARTS MADE OF SAND FOR MAKING METAL CASTINGS

[76] Inventor: Horst-Werner Michel, Jahnstrasse 25, D-7707 Engen, Fed. Rep. of Germany

[21] Appl. No.: 379,073

[22] Filed: May 17, 1982

Related U.S. Application Data

[60] Division of Ser. No. 155,526, Jun. 2, 1980, Pat. No. 4,359,082, which is a continuation of Ser. No. 928,901, Jul. 28, 1979.

[51] Int. Cl.[3] ..... B22C 9/12

[52] U.S. Cl. ..... 164/154; 164/16

[58] Field of Search ..... 164/12, 16, 154, 159

[56] References Cited

U.S. PATENT DOCUMENTS 4,132,260 1/1979 Luber ..... 164/16

FOREIGN PATENT DOCUMENTS 2413537 10/1975 Fed. Rep. of Germany ..... 164/16

25292 7/1973 Japan ..... 164/16

*Primary Examiner*—Kuang Y. Lin

*Attorney, Agent, or Firm*—Price, Heneveld

[57] ABSTRACT

An account is given of a method and apparatus for hardening mold parts, such as mold outer parts or mold cores for making metal castings, by using compressed air for forcing catalyst through the sand of the mold parts for reaction with a binding agent mixed with the sand.

9 Claims, 2 Drawing Figures

APPARATUS FOR HARDENING MOLD PARTS MADE OF SAND FOR MAKING METAL CASTINGS

This is a division of application Ser. No. 155,526, filed June 2, 1980, now U.S. Pat. No. 4,359,082, which patent is a continuation of application Ser. No. 928,901, filed July 28, 1979.

BACKGROUND OF THE INVENTION (1) Field of the invention

The present invention has to do with a method for hardening mold parts, that is to say mold cores and hollow mold parts, made of sand with the addition of a binding agent or binding agents able to be hardened by a catalyst, and used for making metal castings.

(2) Prior Art

In this respect the starting point of the invention is a method, whose development I was responsible for, in the case of which a certain amount of a liquid catalyst is put in the mold part with the help of compressed air, with which the catalyst is mixed, and then the mold part is cleared or rinsed with catalyst-free compressed air.

It is important to make certain that there is an even distribution of the mist, produced by mixing catalyst and compressed air, throughout the mold parts, without drops of catalyst being retained on only some of the grains of sand and not transported fully into the remote portions, that is to say all portions of the mold part. For this purpose I made a suggestion of using a heating system for heating the mist evenly before leaving the mixing zone so that the catalyst is changed into a gas. For this reason it is a compressed air-catalyst gas mixture which goes into the mold part. This is something which promotes a quicker movement of the catalyst through the mold part material and, for this reason, a qucker hardening of the mold parts.

However, in comparison, such a manner of operation requires a great amount of energy, because the mist has to be heated up, generally speaking, from the temperature of the compressed air, which is generally between 0° and 20° C., to the temperature for changing the catalyst into its gaseous form, this being necessary every time the mist is forced through to the mold parts.

The starting temperature is normally towards the lower end of the given temperature range, because the compressed air is caused to give up moisture by forcing it through refrigeration dryers. If it is to be heated, it is naturally necessary for heat to be used, for the compressed air in this respect. Furthermore, in this method the heating only takes place during a short time interval in the working step in question so that it is not possible to make certain that in fact there is a complete change of the catalyst into the gas form.

OBJECTIVES OF THE INVENTION

One purpose of the invention is that of making certain the catalyst completely changes into its gaseous form and accomplishes this with very much smaller amounts of energy.

For effecting this and other purposes in the invention, the compressed air is heated in a normal way for the working run and the liquid catalyst is changed into its gaseous form in a shut-off chamber during the time interval between the working runs in the expanded but still hot air remaining from that which had been used for clearing.

So, in the invention the time interval between the working runs, is used for changing the catalyst into its gaseous form and, because of the repeated motion of hot compressed air through the gas-producing and/or mixing zone, the zone is kept unchangingly at an increased temperature level so that it is no longer necessary for heating to take place from low temperatures to the gas-producing temperature, this resulting in the use of less energy.

The use of heated compressed air for the hardening of such cores or molds, that is to say mold parts, forms part of a suggestion for example as disclosed in the German specification (Auslegeschrift) 2,546,032. However in that case use is not made of liquid catalyst and in fact the catalyst together with the heated compressed air in the form of a supporting gas-catalyst mixture is put into contact with the material to be conditioned. This old method, however, has the shortcoming that the amount of catalyst is measured by fixing the opening times of the valves and, furthermore, is dependent on the pressure and temperature. In the method of my present invention, on the other hand, the catalyst may be put in very exact amounts using a measuring or metering pump. In order in the old method to have, even roughly, a sufficient amount of catalyst it was necessary to make use of catalyst in amounts which were in fact greater than needed, because it was only possible by this means to make certain that the minimum amount of catalyst necessary did in fact make its way into the mold parts everytime. However the amounts which were more than the amount in fact needed were released into the outside air, affecting this air.

An apparatus for using the method of the invention may have a pressure line joined with a mixing chamber, an outlet line joined with the mixing chamber for the liquid catalyst, a heating system and control valves, for controlling the admission of compressed air and of the catalyst to the mixing chamber in step with the working runs, characterised in that the heating system is joined with the inlet of the mixing chamber and between the mixing chamber and the mold part, that is to say the core or outer mold part, there is a further shutoff valve.

The result is that the whole zone between the shutoff valve or the inlet of compressed air to the mixing chamber and a shutoff valve between the mixing chamber and the core mold part may be used as an evaporation chamber for the liquid catalyst, and this evaporation chamber is kept all the time at a temperature which makes evaporation possible and relatively higher temperatures may be used during time intervals between the separate working steps for effecting evaporation. The heating system in the form of a heating chamber may, in this respect be made greater in size, by using insert blocks so that a generally larger heat reserve is available for the gas-forming operation. Because, in this zone, heating no longer has to take place from the compressed air temperature to the gas-forming temperature, the energy demand is dependent only on the energy needed for keeping the heat reserve at the desired working temperature in question. To prevent heat going from this evaporation zone to the volumetric displacement pump and, for preventing the changing of the catalyst into its gaseous form on its way into this gas-forming zone, it is best, although not completely necessary, to provide cooling between the pump and the gas-forming zone. As far as possible, this should be done immediately adjacent the gas-forming zone. This cooling may be effected by a pipe system through which the cool or cold compressed air is forced.

DETAILED ACCOUNT OF INVENTION

Figure 1:
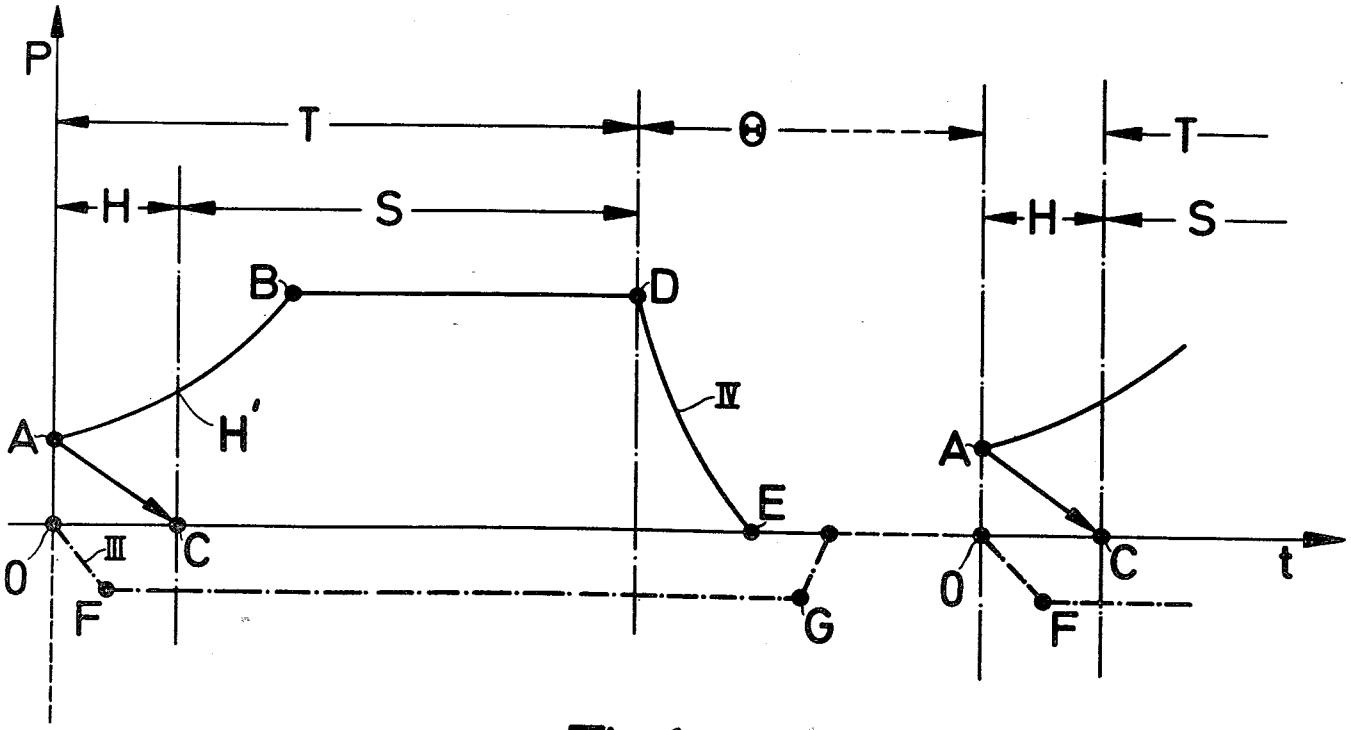
FIG. 1 is a diagrammatic representation of the operating cycle of the method of the invention.

In the diagram of FIG. 1 the horizontal axis is represents time t, while the vertical axis represents pressure P.

At the zero point the working run or operating cycle is started. It has a working step or phase T and a rest step or phase $\theta$. The top curve or line is representative of the pressure behavior of the inlet compressed air. Below it, the decrease in the quantity of the catalyst in gaseous form in the working step is represented by an arrow, while the lowermost curve is representative of the takeup of the catalyst and the introduction of the catalyst.

At the time zero, that is to say O, the inlet compressed air has a pressure value A of, for example, 2 bar, which is controlled by a valve system to be detailed later. In the working step the pressure may undergo an increase of, for example, up to 6 bar, a value which is attained at B. At the time O at the pressure A there is exists catalyst in gaseous form in the mixing zone, which zone is made up of the heating system and the mixing chamber. This catalyst is forced out during time H by the admission of compressed air and is reduced to an amount of equal to zero at the point C. Starting at the point C in time, the hardening is stopped at point H' and the clearing cycle is started in the clearing time S, which is terminated at the point D in time. At this point in time, the system is shut off from the compressed air inlet or line so that the pressure of the compressed air may be expended completely and finally the pressure will be at a normal value at E the same as the outside pressure. So the time T of a working step or phase comes to an end and the rest step $\theta$ is started.

Furthermore at the time O the takeup pump for the liquid catalyst will have been started and it continues working till the point F. As is to be seen, the position of this point F is dependent on the amount of catalyst to be used. On getting to the point F the pump is stopped, something which is made clear by the broken-line curve running parallel to the time axis. This curve extends past the time point E as far as the point G in time and after this time point the pump will be forcing the liquid catalyst into the part of the apparatus made up of the heating system and the mixing chamber, as is made clear by the curve extending as far as the point H in time. For this reason the complete working step will have been ended and it will be started again after a the rest step or phase $\theta$ at another starting point O. The working run is, for this reason, made up of the working step of time T and the rest step of time $\theta$, it being specially important to the invention that the rest time $\theta$ is used for the forcing in of the liquid catalyst and, at the same time, evaporation of the liquid catalyst, which is on hand in its vapor or gaseous condition by the start of the next working step time T. It is naturally necessary for the rest time, in cases in which, for example, the apparatus is not used overnight, to be bridged over by turning on the heating even before the start of the next working step time T in order, at the start of the working step time, to have on hand catalyst in its vapor or gaseous form. However this starting up does not cause any change in the general operation or theory of the apparatus, that is to say, the compressed air released into the mixing chamber will have available a vapor or gaseous catalyst for transport into the core and into the outer mold part.

Figure 2:
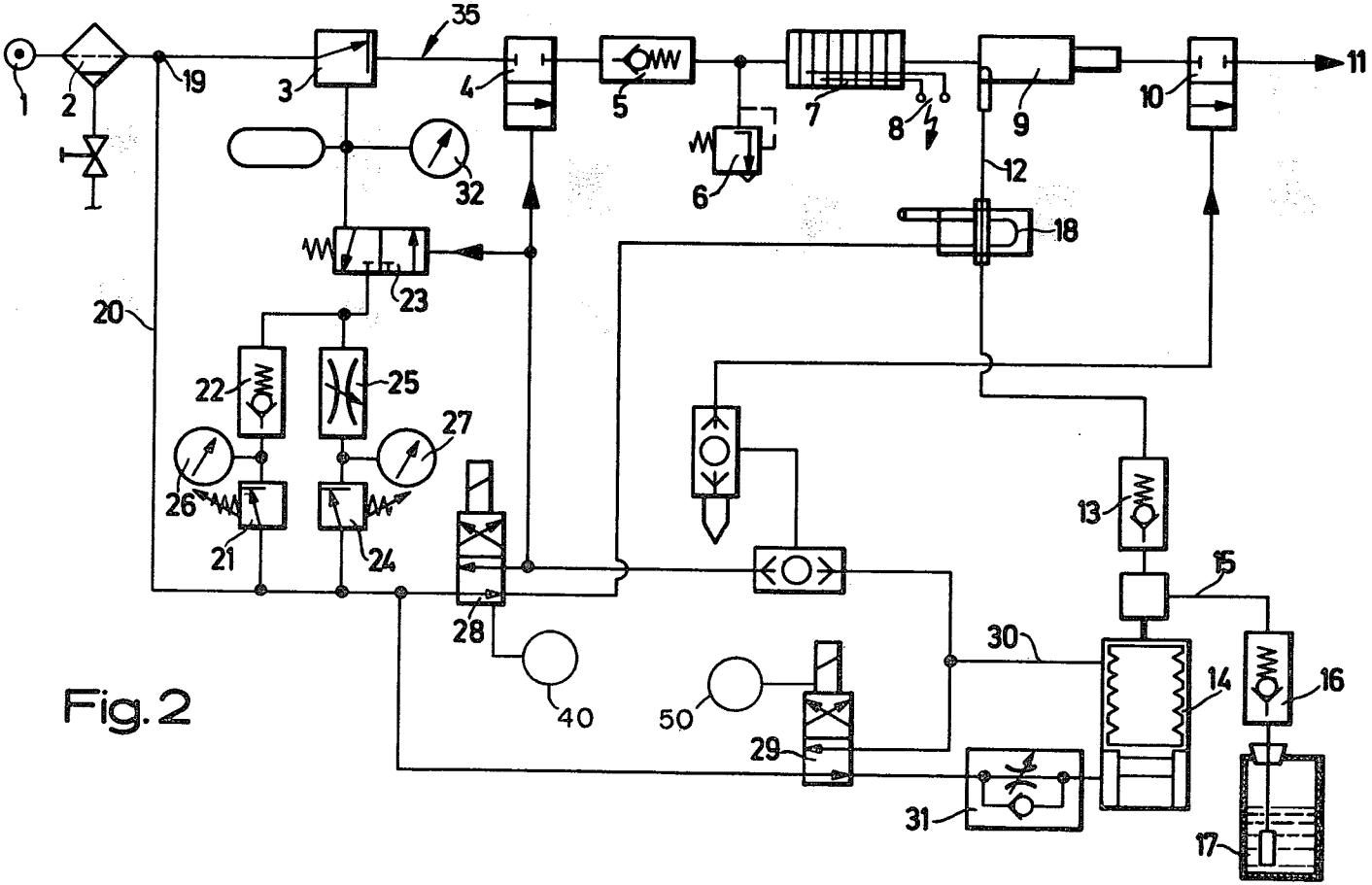
FIG. 2 is an equipment and flow diagram of the invention.

In the apparatus to be seen in FIG. 2 reference no. 1 identifies the connection with the compressed air line, which for example has a pressure of 6 bars. Reference no. 2 identifies a water, oil and dirt trap for making certain that the apparatus is only used with clean compressed air.

The incoming compressed air goes to the automatic control valve 3, which is operated by a part of the apparatus to be detailed later. From the automatic control valve 3 the compressed air goes to the shut off valve 4 by which it is possible for the unit, made up of the heating system and the mixing chamber, to be shut off or isolated from the compressed air line.

At 5 there is a safety check valve while reference number 6 identifies an overpressure valve acting as a safety valve of normal design and so needing no detailed account.

In a heating chamber 7, made more specifically of aluminum, there is a duct made during casting of the chamber for the transport of compressed air through the chamber. Naturally it is possible to make use of any other heating system of the necessary design. Reference number 8 identifies the power connection, for example to electric power, for the heating chamber. From the heating chamber the compressed air goes into the mixing chamber 9 and from it through a shut off valve 10 in the direction of the arrow 11 to the core or outer mold part box. The air conduit from the compressed air source 1 to the shut off valve 10 forms an air passage 35.

In the mixing chamber there is the opening of a duct 12, which runs from a measuring pump 14. The duct 12 has a check valve 13 in it. The measuring (or metering) pump 14 obtains the liquid catalyst through the supply line 15 and a check valve 16 from the tank 17. The pump takes the liquid catalyst from the tank 17 forcing it, after shutting off the check valve 16, through the check valve 13 into the mixing chamber 9. In the duct 12 I have placed a cooling tube 18 for making certain that the heat from the heating system 7 and the mixing chamber 9 is not conducted by the duct to the pump 14, thus stopping any premature evaporation of liquid catalyst in this part. A portion of the compressed air coming from the line 1 is branched off at 19 through the duct 20 as control air. This control air goes through a pressure-decreasing valve 21 and a check valve 22 to an air-operated control valve 23. Also through a pressure-decreasing valve 24 and a control choke 25, the compressed air is supplied to the control valve 23. The pressures, fixed by adjustment, may be seen at once by reading the pressure gages 26 and 27. If a time control clock 40 is used for working the control valve 28, this control valve 28 will operate, on the one hand, the valve 4 and on the other hand of the valve 23 so that first air at the lower pressure, for example 2 bars, will be passed through the automatic control valve 3 and the valve 4 and the check valve 5 into the line going to the heating chamber 7. At the same time the valve 29 is operated, which makes possible the movement of air through the duct 30 to the measuring pump 14 so that the pump's piston is moved downwards and the necessary amount, fixed by adjustment, to withdraw liquid catalyst from the tank 17 into the pump. This operation is illustrated in FIG. 1 as the drop in the catalyst curve III between the points O and F. The speed of take-up may undergo adjustment with the help of a choke valve 31. At the same time as the operation of the valves 28 and 29, the valves 4 and 10 are opened by way of the lines used for this purpose. Because, in the unit made up of the heating chamber and the mixing chamber the necessary mixture of air and catalyst in gaseous form is present from the preceding working step, this mixture is now forced by the compressed air, coming from the compressed air line, through the open valves to the core box. When this is done the valve 3 is smoothly opened further because the control valve 24, which has been set at a higher pressure value, will be operating the valve 3 more and more, through the valves 25 and 23, until a certain pressure value is produced, as is the case at point B in FIG. 1.

This point is attained after the whole of the catalyst in gaseous form has been forced into the core on reaching the point C, and then the clearing time is started as well. At the end of the clearing time, that is to say on reaching point D in the graph of FIG. 1, the valve 28 is switched off by the clock 40 so that the valve 4 is shut. The valve 10 is kept open by the valve 29, which is controlled by a second clock 50, but up to this point has not been operated. The pressure of the compressed air is for this reason able to undergo a decrease from point D to point E along the curve IV. It is only at point G that the valve 29 has the added effect of shutting the valve 10 so that there is no available or isolated portion of the apparatus, into which from the point G to the point H the quantity of liquid catalyst, taken up in the ump 14 from the tank 17, is forced into the space made up of the heating chamber 7 and the mixing chamber 9. In this space there is heated, unexpanded compressed air, which because of the amount of heat in it, is responsible for changing the catalyst into its gaseous form at once. This gaseous form catalyst is kept in the portion of the apparatus between the valves 5 and 10 and is on hand for the next working operation, which, if necessary, after a long resting time, will take place in quite the same way as detailed.

It is furthermore pointed out that it is possible, by reading the pressure gage 32, to take note of the complete development of pressure of the compressed air as made clear by the curve for the compressed air of FIG. 1. It is for this reason possible to make a change in the form of the curves, as may be desired, by making a further adjustment of the choke 25, and keeping an eye on the changes in the position of the hand of the pressure gage 32.

I claim:

1. An apparatus for hardening sand mold parts of a sand and binder mixture by passing a catalyst through the parts, said apparatus having a source of compressed air and a passage connecting said source to the mold parts, said apparatus characterized by a valve at each end of said passage for closing off and isolating a portion of said passage from both said source and the mold part, a source of liquid catalyst connected to said passage, said liquid catalyst source including means for injecting a measured quantity of catalyst into said passage; said portion of said passage between said valves forming a catalyst vaporizing chamber and a heater for heating air trapped in said chamber to the vaporization temperature of the catalyst; clock means for maintaining said portion isolating valves closed long enough for vaporization of all of the catalyst and for intermittently and simultaneously opening said portion isolating valves at both ends of said passage to pass compressed air through said passage; said clock means being connected to said injecting means for activating said injecting means only when and after said valves are initially closed.

2. The apparatus described in claim 1 further characterized in that said chamber includes two portions arranged in tandem, said heater being in one of said portions of said catalyst injecting means being connected to the other of said portions.

3. The apparatus described in claim 2 further characterized in that said one portion is adjacent said source of compressed air and said other portion is adjacent the mold parts.

4. The apparatus described in either claim 2 or 3 further characterized in that a duct interconnects said catalyst source and said passage, a cooling element mounted in said duct for preventing the conduct of heat from said passage to said catalyst source.

5. An apparatus for hardening by means of a catalyst said mold parts comprised of a sand and binder mixture, said apparatus having a source (1) of compressed air and a passage connecting said source to the mold parts, a first valve (4') in said passage adjacent said source for isolating said source from said passage; a second valve in said passage adjacent the mold parts for isolating the passage from the mold parts; heating means in the isolated portion of said passage; the isolated portion of said passage between said valves being a heating and catalyst vaporization chamber; a source of liquid catalyst and means for injecting a measured quantity of the liquid catalyst into said chamber means; timer means connected to said first and second valves and said injection means for opening and closing said valves sequentially and activating said injection means while the valves are closed.

6. An apparatus as described in claim 5 wherein said catalyst source is spaced from said chamber means, a duct interconnecting said catalyst source and chamber means; a thermal energy absorbing element in said duct for limiting the transfer of heat from the chamber means to said catalyst source.

7. An apparatus as described in claim 5 wherein a heating means is provided for said chamber means, said heating means being between said compressed air source and the point of injection of the catalyst into said chamber means.

8. An apparatus as described in claim 7 wherein said chamber means includes a pair of portions arranged in tandem said heating means being in the portion adjacent said source of compressed air.

9. An apparatus as described in claim 8 wherein said point of injection of the catalyst is in the chamber adjacent the mold parts.

* * * * *

UNITED STATES PATENT AND TRADEMARK OFFICE

CERTIFICATE OF CORRECTION

PATENT NO. : 4 483 384

DATED : November 20, 1984

INVENTOR(S) : Horst-Werner Michel

It is certified that error appears in the above-identified patent and that said Letters Patent is hereby corrected as shown below:

Column 5, line 31:
"no available or" should be --now available an--

Column 5, line 33:
"ump" should be --pump--

Column 6, Claim 2, line 16:
"of" should be --and--

Signed and Sealed this

*Twentieth* Day of *August 1985*

[SEAL]

*Attest:*

DONALD J. QUIGG

*Attesting Officer*

*Acting Commissioner of Patents and Trademarks*